United States Patent [19]

Vierto

[11] Patent Number: 5,040,402

[45] Date of Patent: Aug. 20, 1991

[54] BODY CLAMP FOR AN AUTOMOBILE BODY STRAIGHTENER

[76] Inventor: Raine Vierto, Viertola, 03320 Selki, Finland

[21] Appl. No.: 603,667

[22] PCT Filed: Jan. 22, 1990

[86] PCT No.: PCT/FI90/00025

§ 371 Date: Oct. 31, 1990

§ 102(e) Date: Oct. 31, 1990

[87] PCT Pub. No.: WO90/07993

PCT Pub. Date: Jul. 26, 1990

[30] Foreign Application Priority Data

Jan. 23, 1989 [FI] Finland ..... 890327

[51] Int. Cl.[5] ..... B21D 1/12

[52] U.S. Cl. ..... 72/422; 72/705

[58] Field of Search ..... 72/422, 457, 705

[56] References Cited

U.S. PATENT DOCUMENTS 4,070,899 1/1978 Venalainen ..... 72/705

FOREIGN PATENT DOCUMENTS 454335 4/1988 Finland .
874313 2/1990 France .
WO8902791 4/1989 PCT Int'l Appl. .

*Primary Examiner*—Lowell A. Larson
*Attorney, Agent, or Firm*—Barnes & Thornburg

[57] ABSTRACT

A body clamp for an automobile body straightener, consisting of a main body which can be fastened to a straightener frame beam and has a pair of jaws attached to it. One jaw is fixed to the main body and the other jaw is rotatably mounted on a shaft attached to the main body. The body clamp is provided with a cam closing devices to press the rotatable jaw against the fixed jaw. The cam closing device is rotatably mounted on a shaft attached to the movable jaw so that when the cam closing device is pressed with a force (G) against the frame beam, it will generate a clamping force (F) between the jaws, with the result that the body clamp is simultaneously fastened to the straightener frame beam when the jaws are closed.

4 Claims, 1 Drawing Sheet

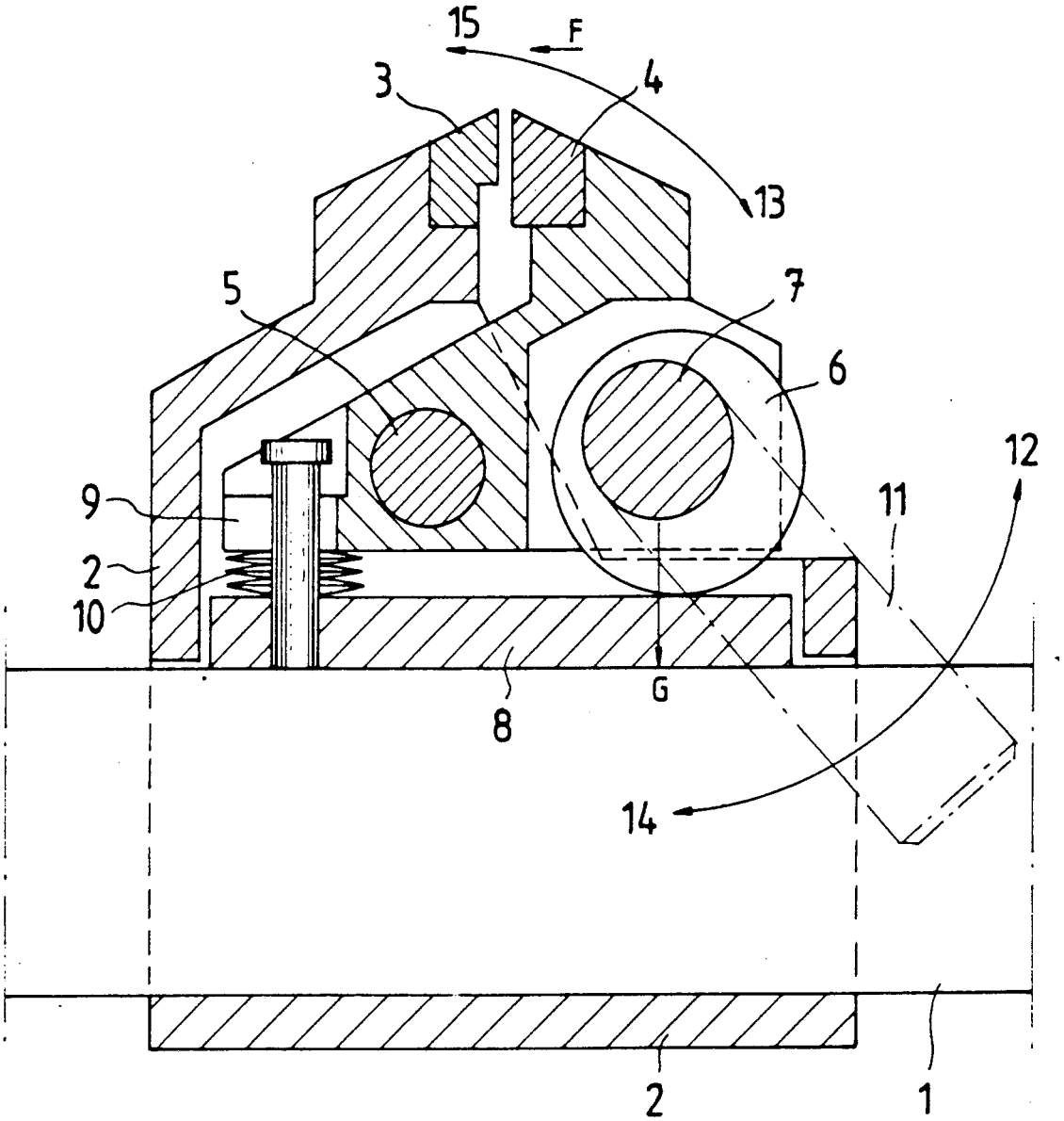
15
F
3
4
13
5
7
6
12
9
11
2
10
G
8
14
2
1

BODY CLAMP FOR AN AUTOMOBILE BODY STRAIGHTENER

BACKGROUND AND SUMMARY OF THE INVENTION

The present invention relates to a body clamp for an automobile body straightener, consisting of a main body which is fastened to a straightener frame beam and has a pair of jaws attached to it. One jaw is fixed to the main body and the other is rotatably mounted on a shaft attached to the main body. The body clamp is provided with a cam closing device, by means of which the rotatable jaw can be pressed against the fixed jaw and the clamp simultaneously fastened to the straightener frame beam when the jaws are closed.

Finnish patent application 874313 describes a body clamp of this general type. The object of the invention is to further develop the body clamp and its action.

The body clamp of the invention is characterized in that the closing device is rotatably mounted on a shaft attached to the movable jaw, so that, when the closing device is pressed against the frame beam, it will generate a clamping force between the jaws. The invention makes it possible to quickly fasten the automobile body by its edges to the straightener, while at the same time fastening the straightener to the frame beam. Since the closing device is mounted on the movable jaw, the clamping and fastening forces will be independent of the thickness of the automobile body edge gripped by the jaws.

The invention provides that during clamping, the cam closing device is pressed against a spacer belonging to the cam closing device to transmit pressure to the frame beam. Thus, the fastening pressure applied to the frame beam will be evenly distributed.

The invention also provides that the movable jaw is provided with a toe which, in relation to the cam closing device, is placed on an opposite side of the jaw rotation shaft. During clamping, the toe applies a pressure via a spring to the spacer. The spring pressure is removed when the clamp is released. Thus, both ends of the fastening plate will be evenly pressed against the frame beam.

Other objects, advantages and novel features of the present invention will become apparent from the following detailed description of the invention when considered in conjunction with the accompanying drawings.

BRIEF DESCRIPTION OF THE DRAWING

The figure shows a schematic cross-sectional view of the body clamp.

DETAILED DESCRIPTION OF THE DRAWING

The body clamp for an automobile body straightener consists of a main body 2 which can be fastened to a straightener frame beam 1 and is provided with a pair of jaws 3, 4 attached to it. One 3 of the jaws is fixed to the main body 2 while the other jaw is rotatably mounted on a shaft 5 attached to the main body 2. The movable jaw 4 can be pressed against the other jaw 3 by a cam closing device 6. The cam closing device 6 is rotatably mounted on a shaft 7 attached to the movable jaw 4, so that, when pressed against the frame beam 1, the closing device 6 will produce a clamping force F between the jaws 3, 4. When the jaws 3, 4 are pressed against each other, the body clamp is simultaneously fastened to the frame beam 1 by force G. The thickness of the edge gripped by the jaws has no effect on the clamping and fastening forces F, G. During clamping, the cam device 6 is pressed against a spacer 8 belonging to the closing device and transmitting a force G to the frame beam. The movable jaw 4 is provided with a toe 9, placed on the opposite side of the jaw axle 5 in relation to the closing device 6. During clamping, the toe 9 applies a pressure via a spring 10 to the spacer 8. When the body clamp is opened by turning the lever 11 in direction 12, the spring pressure 10 causes the jaw 4 to rotate in opening direction 13, thereby releasing the spacer and enabling the clamp to be moved along the beam 1 to a desired position. When the lever 11 is turned in the clamping direction 14, the clamp grips the edge of the automobile body as jaw 4 turns in the closing direction 15 while the cam device 5 and springs 10 tighten the clamp on the beam 1.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A body clamp for an automobile body straightener, comprising:

a main body which can be fastened to a straightener frame beam;

a pair of jaws attached to the main body;

one jaw is fixed to the main body and the other jaw is rotatably mounted on a first shaft attached to the main body;

a cam closing means for pressing the rotatable jaw against the fixed jaw and simultaneously fastening the main body to the straightener frame beam;

wherein the closing means is rotatably mounted on a second shaft attached to the movable jaw to press against the frame beam with a force (G) as well as to generate a clamping force (F) between the jaws.

2. A body clamp according to claim 1, wherein during clamping, the cam closing means is pressed against a spacer that transmits the pressing force (G) against the frame beam.

3. A body clamp according to claim 2, wherein the movable jaw is movable with a toe which is located on an opposite side of the first shaft from the cam closing means;

wherein during clamping, the toe applies a pressure via a spring to the frame beam via the spacer; and wherein said spring pressure is removed by the cam closing means when the clamp is in the open position.

4. A body clamp according to claim 1, wherein the movable jaw is provided with a toe which is located on an opposite side of the first shaft from the cam closing means;

wherein during clamping, the toe applies a pressure via a spring to the frame beam; and wherein said spring pressure is removed by the cam closing means when the clamp is in the open position.

* * * * *